US005078269A

United States Patent [19]

Dekko et al.

[11] Patent Number: 5,078,269

[45] Date of Patent: Jan. 7, 1992

[54] WIRE SHIPPING AND DISPENSING CONTAINER

[75] Inventors: Chester E. Dekko; Nathan Young, both of Kendallville, Ind.

[73] Assignee: Group Dekko International, Inc., Kendallville, Ind.

[21] Appl. No.: 535,014

[22] Filed: Jun. 7, 1990

[51] Int. Cl.[5] ..... B65D 85/04

[52] U.S. Cl. ..... 206/397; 206/415

[58] Field of Search ..... 53/409, 439, 116; 206/389–417; 242/129, 129.7, 129.71, 129.72, 170

[56] References Cited

U.S. PATENT DOCUMENTS

| | | | |
|---|---|---|---|
| 1,913,477 | 6/1933 | Daubmeyer et al. | 206/401 |
| 2,327,156 | 8/1943 | Scott | 206/397 |
| 2,624,526 | 1/1953 | Green | 206/397 |
| 2,674,372 | 4/1954 | Schweich | 206/396 |
| 2,812,854 | 11/1957 | Fletcher | 206/395 |
| 2,955,738 | 10/1960 | Bacchus et al. | 206/397 |
| 3,314,586 | 4/1967 | Frank, Jr. | 206/395 |
| 3,446,419 | 5/1969 | Mueller | 206/397 |
| 3,780,964 | 12/1973 | Gonzalez | 206/403 |

FOREIGN PATENT DOCUMENTS

| | | | |
|---|---|---|---|
| 0011694 | 2/1928 | Australia | 206/389 |
| 0487380 | 10/1952 | Canada | 206/398 |
| 8402893 | 8/1984 | PCT Int'l Appl. | 206/397 |
| 0232071 | 4/1925 | United Kingdom | 206/396 |

*Primary Examiner*—Jimmy G. Foster
*Attorney, Agent, or Firm*—Roger M. Rickert

[57] ABSTRACT

A two part wire receptacle for receiving wire being laid therein by a flier in a coiled pattern is disclosed. The first part is permanent wire receiving basket has a relatively flat surface with a plurality of upstanding inner wire guide elements defining the inner periphery of the coil and a further plurality of upstanding outer wire guides defining the outer periphery of the coil. Another form of the first part may be embodied in a machine for receiving and packaging wire being laid therein in a coiled pattern. In the machine, a permanent wire receiving basket has a relatively flat surface, a plurality of upstanding inner wire guide elements defining the inner periphery of the coil, and an upstanding generally cylindrical outer wire guide defining the outer periphery of the coil. The second part which functions as a shipping and dispensing container comprises a relatively flat sheet of support material having a peripheral extent approximately coextensive with the outer wire guide elements, a central opening with a peripheral extent approximately coextensive with the inner wire guide elements, and a plurality of bands of tape, cardboard, or similar strap or banding material for fastening a coil of wire to a face of the sheet so that the wire and sheet may be removed as a packaged unit, and a new sheet placed in the basket to receive additionlal wire. The bands comprise a number of lengths of the tape or other material each passing through the central opening, about the coil of wire, and about the outer periphery of the coil of wire and of the support material to close upon itself. The sheet of support material may be formed from corrugated cardboard with the inner and outer peripheral extents formed as concentric regular n-gons having respective edges oriented generally parallel to one another. Square and octagonal peripheries are disclosed as illustrative with the corresponding number (four or eight) of strips of fiberboard, tape or similar banding material, each extending generally orthogonal to a corresponding one of the pairs of parallel edges of the n-gon. The strips are initially flat and generally coplanar with the sheet and are subsequently folded about the sheet of support material and about the coil of wire and fastened in place thereabout to secure the coil of wire to the sheet of support material.

11 Claims, 4 Drawing Sheets

WIRE SHIPPING AND DISPENSING CONTAINER

SUMMARY OF THE INVENTION

The present invention relates generally to shipping containers for coiled material such as insulated electrical wire, and more particularly to an economical container of corrugated cardboard or similar material and formed of a near minimum quantity of packaging material.

Boxes, drums, wooden reels, and cylindrical plastic containers to name but a few, have been used to ship and frequently subsequently dispense coiled materials. All of these techniques work relatively well, but are expensive both in the quantity of material need to form the container and the subsequent disposal or empty return for reuse problems. Moreover, shipping costs are based on gross weight of container and product, not on the weight of the product being shipped. It is simply inefficient to ship a product in more container than is necessary.

A recent attempt to improve on the shipping of coiled material such as wire is represented by U.S. Pat. No. 4,623,063 to Balkin. This patented arrangement provides an octagonal box which entirely encloses the coil with the coil, in turn, encircling an octagonal tubular core centrally located within the box. After the coiled material is deposited within the box encircling the core, a pair of stiffening panels are placed on top the coil and braced simultaneously against inner surfaces of the box and an outer surface of the core. This octagonal container has met with some commercial success, but is still too heavy, is fairly complex to fabricate, and if shipped in a flattened condition, requires considerable assembly time before use.

Among the several objects of the present invention may be noted the provision of a minimal wire shipping and dispensing container; the provision of a container for a coil of wire which encloses less than all of the coil while still encompassing and securing the coil; the provision of a corrugated cardboard pallet for shipping coiled material; the provision of an octagonal cardboard sheet with pre-attached wrapping tabs for securing a coil of wire to the sheet; the provision of an open-faced shipping container for coiled material such as wire where a portion of the wire contained in the container is exposed and visible at all times and the container does not completely enclose the material contained therein; the provision of a shipping arrangement for receiving wire from a flier and for quickly and easily palletizing units of wire so received; the provision of an economical cardboard container for a coil of wire; and the provision of apparatus for adapting current wire processing equipment to take advantage of any of the foregoing objects. These as well as other objects and advantageous features of the present invention will be in part apparent and in part pointed out hereinafter.

In general, a shipping and dispensing container for a generally toroidal coil of wire comprises a generally flat support slab and a plurality of fastening strips completely encircling both the coil of wire and the flat support slab to fasten the coil of wire and support slab securely together in a mutually supporting manner for shipping. The fastening strips are subsequently interrupted to free the coil preparatory to dispensing wire therefrom. Typically, the support slab is corrugated cardboard and the fastening strips are tape or cardboard fastened in place by tape.

Also in general and in one form of the invention, a device for removing wire from a rotating flier includes a permanent support slab, a temporary support slab, pre-attached tabs on the temporary support slab, and inner and outer peripheral wire guides on the permanent support slab, the permanent slab, the inner and outer peripheral wire guides, and the temporary slab cooperating to receive wire from the flier whereupon the pre-attached tabs may be folded over the wire received on the temporary support slab and the temporary support slab, wire and tabs may be removed as a unit for shipment and subsequent handling.

Still further in general, a device for removing wire from a rotating flier includes a permanent flat support slab, a temporary support slab, pre-attached tabs on the temporary support slab, and inner and outer peripheral wire guides movable in a direction generally normal to the premanent support slab between extended and retracted positions. The temporary support slab is superposed with the permanent support slab and cooperates with the extended inner and outer peripheral wire guides to receive wire from the flier whereupon the inner and outer peripheral wire guides are retracted and the wire and temporary support slab is moved to another location where the pre-attached tabs are folded over the wire received on the temporary support slab and the temporary support slab, wire and tabs are then removed as a unit for shipment and subsequent handling.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
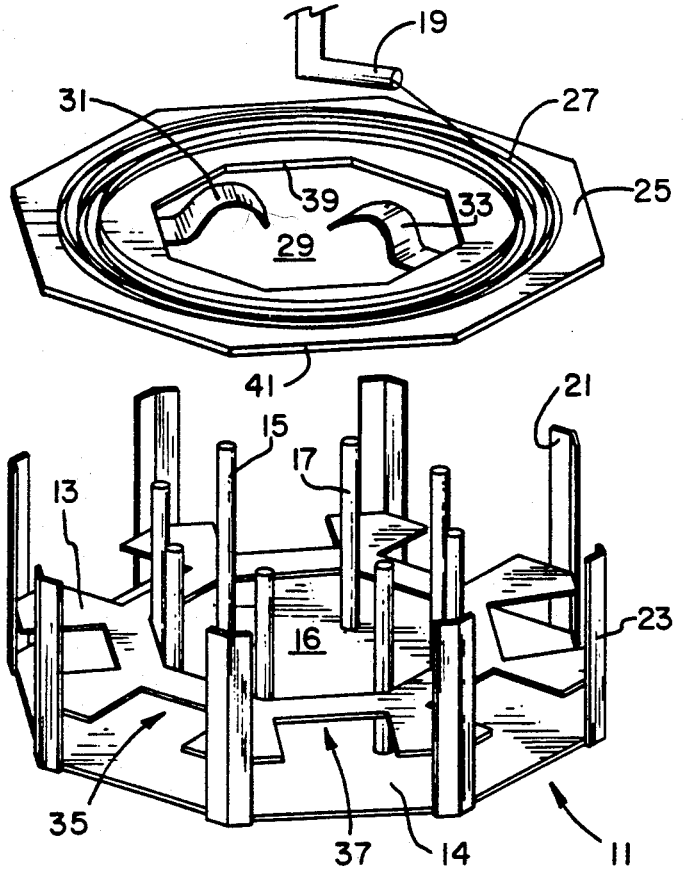
FIG. 1 is an exploded perspective view of temporary and permanent support slabs for receiving wire from a rotating flier.

Referring first to FIG. 1, a permanent wire receiving basket 11 having a relatively flat surface 13 supports a plurality of upstanding inner wire guide elements or pins such as 15, and 17 which define the inner periphery of a coil of wire being dispensed from a flier 19 and a further plurality of upstanding outer wire guides such as 21 and 23 defining the outer periphery of the coil. The inner pins 15, 17 and outer guides 21, 23 may be welded to the flat surface 13 and to a base member 14 of outer shape similar to the surface 13, but not necessarily having the inner opening 16 nor notches 35, 37. For illustrative purposes only, the vertical spacing between the solid base 14 and the notched support surface 13 may be about two inches while the pins 15, 17 and outer guides 21, 23 extend upwardly from the surface 13 another eight inches for a wire receiving basket having an outer diameter of about eleven inches and an inner diameter of about six inches. Under these circumstances, the notches 35, 37 and about five inches in width. A relatively flat sheet of support material 25 normally rests on support surface 13 and receives the coil 27 of wire. The support sheet may, for example be of conventional corrugated cardboard and has an octagonal peripheral extent approximately coextensive with the outer wire guide elements 21, 23 and a central opening 29 with a peripheral extent approximately coextensive with the inner wire guide elements 15, 17. The sheet of support material also has a plurality of bands such as strips of tape 31 and 33 pre-attached to the sheet for fastening a coil of wire 27 to one face of the sheet so that the wire and sheet may be removed as a packaged unit, and a new sheet placed in the basket 11 to receive additional wire. The strips of tape are passed upwardly through the central opening 29, about the coil of wire 27, and about the outer periphery of the coil of wire and of the support material to close upon itself. The slots such as 35 and 37 in the base plate 13 allow the tape to be passed beneath the typically corrugated cardboard support sheet and easily adhered thereto as at 43 in FIG. 3.

The sheet of support material has inner and outer peripheral extents which are formed as concentric regular n-gons (where n=8 in FIGS. 1-5 and n=4 in FIGS. 6 and 7) having respective inner 39 and outer 41 edges oriented generally parallel to one another and the corresponding n strips of tape or fiberboard material, each extend generally orthogonal to a corresponding one of the pairs of parallel edges. The strips are wrappable or foldable about the sheet of support material and about the coil of wire and fastenable in place thereabout to secure the coil of wire to the sheet of support material.

Figure 2:
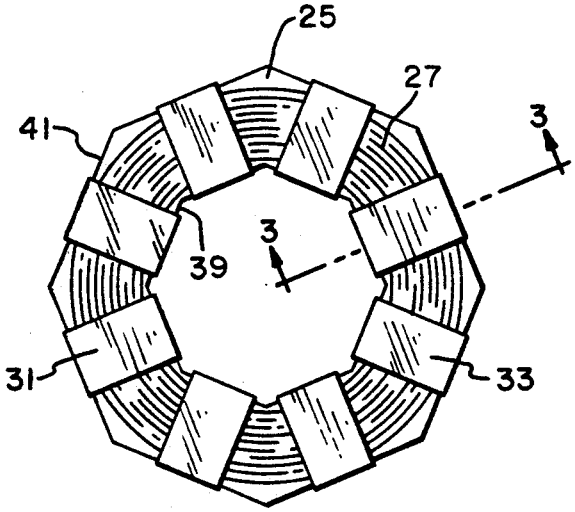
FIG. 2 is a top view of wire packaged for shipment on the support slab of FIG. 1.
Figure 3:
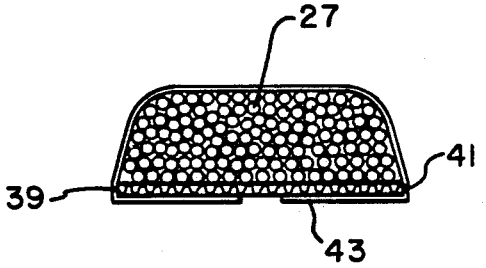
FIG. 3 is a view in cross-section along lines 3—3 of FIG. 2.
Figure 4:
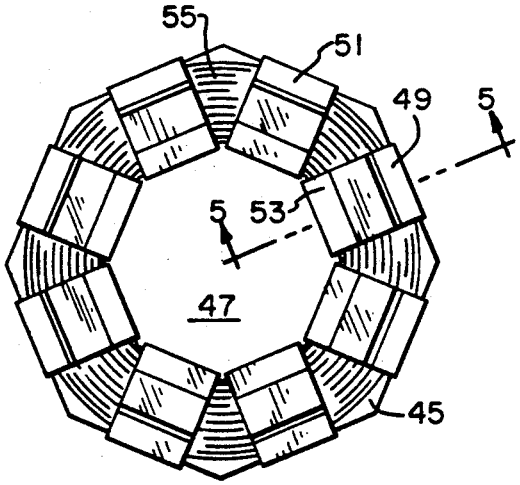
FIG. 4 is a view similar to FIG. 2, but illustrating an alternate form of pre-attached tab for holding the wire on the slab.
Figure 5:
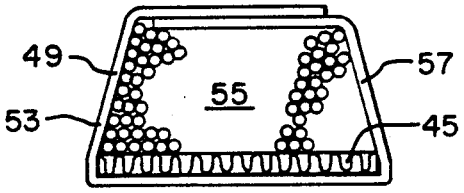
FIG. 5 is a view in cross-section along lines 5—5 of FIG. 4.

The open-faced container of FIGS. 1-3 simply comprises an octagonal base of corrugated cardboard with an octagonal central opening and with eight strips of tape pre-attached and ready to encircle a coil of wire received on the support. This and all the other illustrated embodiments are open-faced shipping containers in that a portion of the wire contained in the container is exposed and visible at all times and the container does not completely enclose the material contained therein. In FIGS. 4 and 5, a similar octagonal base of corrugated cardboard 45 with an octagonal central opening 47 has eight strips of fiberboard or corrugated cardboard such as 49 and 51 pre-attached thereto and extending generally perpendicular to the respective edges. During shipping of the containers and preparatory to use, these strips lie flat and generally in the plane of the support sheet. When the container is readied to receive wire, the inner portions 53 are folded upwardly to fit within the inner guide pins 15 and 17 and wire 55 is deposited onto the sheet 45 of support material as before. The outer portion 57 of the strip is then folded over the wire and the inner portion folded down on top of the outer portion 57. The two strip ends are joined by a pre-applied adhesive on one portion of the strip or by an additional strip of tape as desired.

Figure 6:
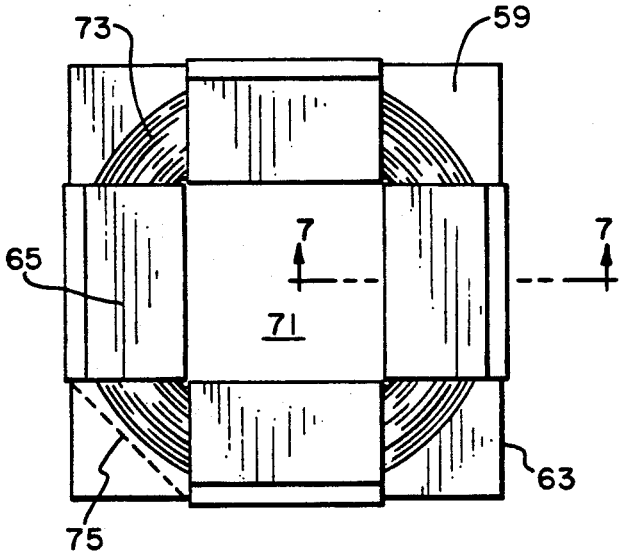
FIG. 6 is a view similar to FIGS. 2 and 4, but illustrating a variation on the peripheral configuration of the slab.
Figure 7:
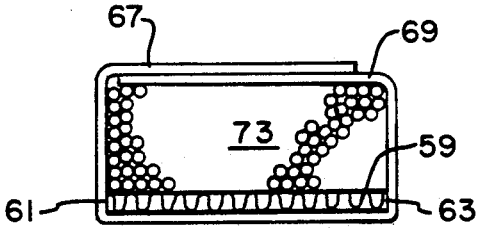
FIG. 7 is a view in cross-section along lines 7—7 of FIG. 6.

An octagonal configuration has thus far been illustrative of the invention. FIGS. 6 and 7 show that other shapes are possible. The support sheet 59 in FIG. 6 has square inner 61 and outer 63 peripheries and pre-attached fiberboard strips such as 65. Each strip has an inwardly extending portion 67 and an outwardly extending portion 69. When initially shipped, the container is flat with the inwardly extending portions 67 overlapping one another in the otherwise open square central portion 71. The strips are folded over the wire coil 73 and fastened by adhesive or additional tape as before.

It is possible in FIGS. 6 and 7, as with the earlier embodiments, to provide a second, typically corrugated, cardboard sheet to function as a "lid" being placed over the upstanding inner portions 67 before those portions are folded outwardly. Thus, the lid portion would be trapped beneath the overlapping portions of the strip. The square embodiment of FIGS. 6 and 7 allows for the illustration of yet a further modification. The corners of support 59 may be folded up at the four corners along diagonal lines such as 75 and the lid folded downwardly along similar diagonal lines and those triangular tips joined by additional tape thereby converting the outer periphery into an octagonal configuration while the inner opening 71 remains square. A permanent form along the lines of the basket 11 in FIG. 1, but modified to accommodate the four sided configuration when receiving wire will be readily apparent in light of the forgoing discussion.

Figure 8:
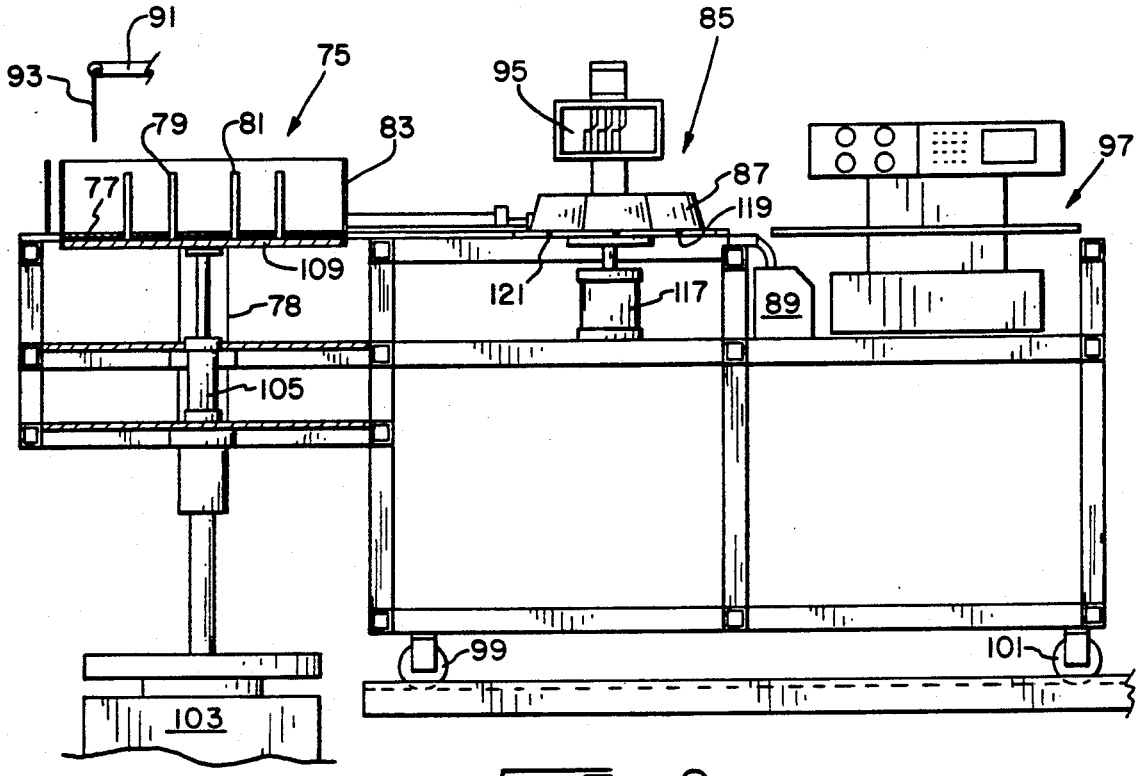
FIG. 8 is a side elevation view of machinery for adapting current wire processing equipment to dispense wire into open-faced containers for transporting, storing and subsequently dispensing such wire.
Figure 9:
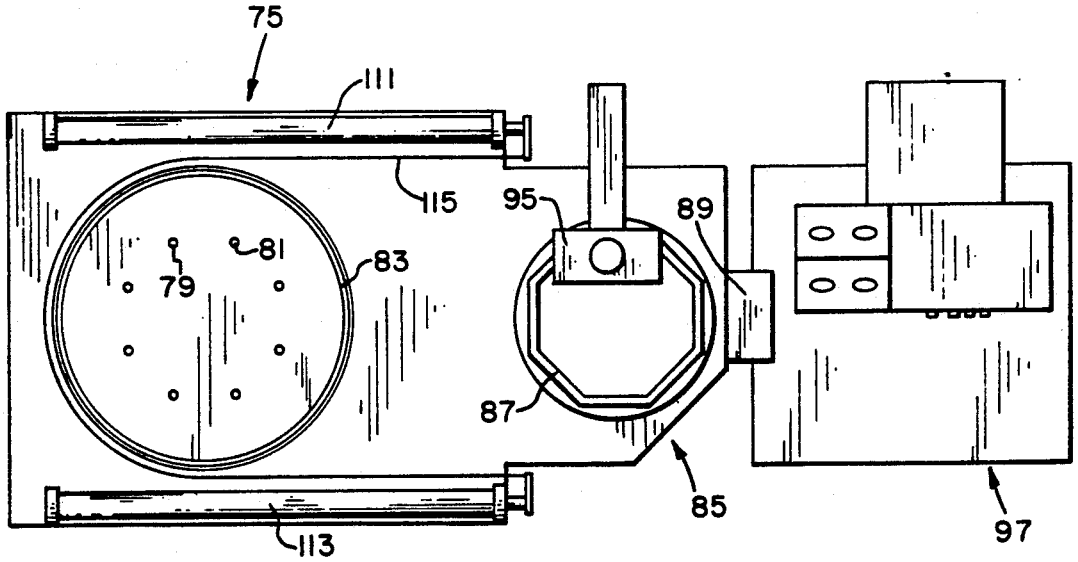
FIG. 9 is a top plan view of the machinery of FIG. 8.
Figure 10:
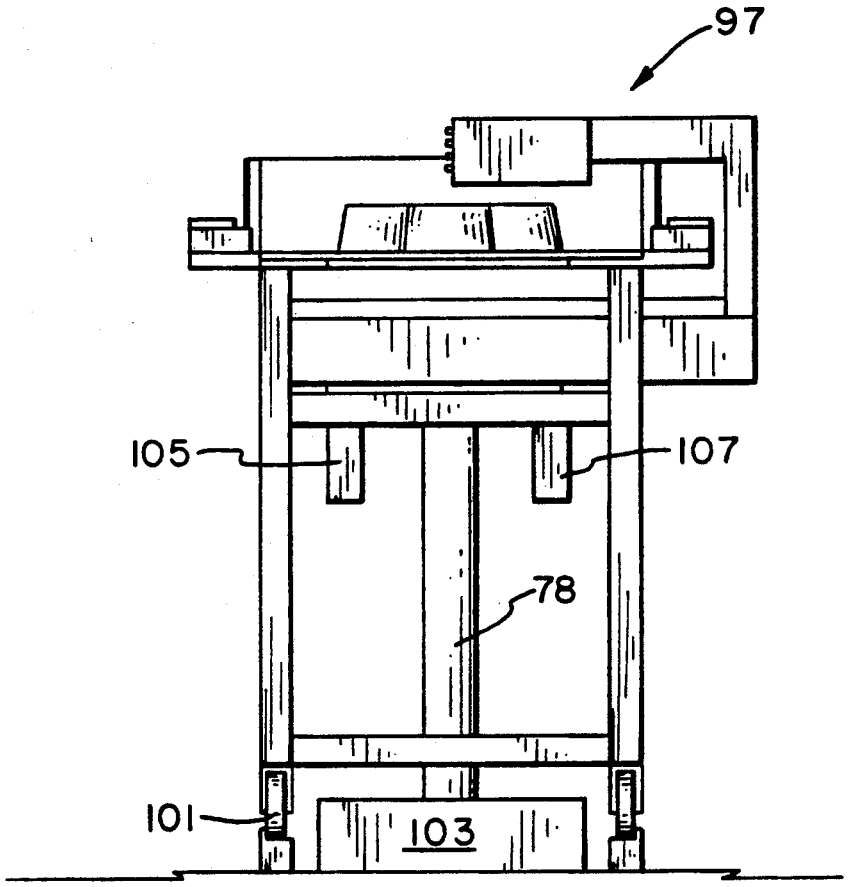
FIG. 10 is an end elevation view of the machinery of FIGS. 8 and 9.

In FIGS. 8-10 there is illustrated a wire receiving, translating and packaging machine having a wire receiving station 75 including a fiberboard sheet receiving platform 77, inside periphery defining pins such as 79 and 81, and an upstanding generally cylindrical outer wire guide 83 for defining the outer peripheral extent of a coil of wire laid onto fiberboard, for example, a corrugated cardboard material, disposed on surface 77. There is a second station 85 laterally adjacent the wire receiving station 75 to which the fiberboard sheet and coil of wire laid thereon may be translated for further processing including the wrapping of tape about the coil of wire and fiberboard sheet to insure that the wire remains joined with the fiberboard sheet during subsequent handling and shipping. Translation of the wire pack from station 75 to station 85 may be accomplished manually, but a pair of air or hydraulic cylinders 111 and 113 with an upright band 115 extending around the wire pack and connected to each cylinder piston may be actuated to pull the wire pack toward the second station. The fiberboard sheet may be much the same as discussed in conjunction with FIGS. 1-3 having a plurality of strips of tape adhered thereto and including a central open region into which free ends of the strips of tape extend. The second station 85 includes a tape displacing head 87 which is passed upwardly by actuation of the air or hydraulic cylinder 117 through the aligned central openings of the fiberboard and coil of wire urging the free tape ends initially upwardly through the two central openings after which an operator moves the tape free ends radially outwardly, down and radially inwardly to close on themselves and encircle the sheet of fiberboard and the wire. One illustrative type of tape which may be used throughout the examples of this application is a conventional reinforced paper tape having one side coated with a water soluble adhesive. When the tape is of this type, the second station may also include a mister 89 which provides a fine water spray to the underside of the fiberboard where the tape strips have been prefastened for wetting the tape causing the tape to adhere in position about the coil of wire and fiberboard sheet. In practice, the mister may wet the back (nonadhesive) side of the tape or the fiberboard and when the adhesive side is brought around and into contact, it is wet and adheres as desired. A plate attached to the tape displacing head 87 and containing a series of ball detents 119 and 121 used to actuate the mister supports the wire pack at this time and a chain or similar drive may be employed to rotate the wire pack in steps of ⅛ of a complete revolution to mist in turn the nonadhesive faces of each of the eight pieces of tape on the underneath side.

The device shown in FIGS. 8-10 is designed for removing wire from a rotating flier such as may be found on the conventional and well known Endex drum packer. In conjunction with such a machine, the wire 93 is dispensed or supplied continuously from flier 91 and the drum packing machine includes hooks which may be selectively positioned beneath the flier to temporarily accumulate wire while the wire pack is being removed from the permanent flat support slab and moved away from the first station and a new temporary support slab with its pre-attached tabs is being positioned between the inner and outer peripheral wire guides. The wire guides 79, 81 and 83 are movable in a vertical direction generally normal to the permanent support slab between an extended wire receiving position and a retracted position for facilitating translation of a coil to the second station.

The second station may further include a cutter arrangement 95 for severing the wire to separate the coil from wire continuing to exit the flier. The cutter arrangement 95 may simultaneously cut the wire and strip insulation of the two ends near the cut thereby preparing the wire ends for customer use. After cutting the wire free and taping the coil to the fiberboard, the packaged wire is translated to a third station 97 adjacent the second station for weighing and labeling. Information indigenous to the particular package of wire including weight, wire gauge and length, customer identification information and other information may be printed or bar coded onto a label and affixed to the tape on the package of wire.

The equipment of FIGS. 8-10 is mounted on rollers such as 99 and 101 to be easily movable into position beneath the rotating flier 91 which as noted earlier may be a part of a conventional and well known Endex drum packer. In such a conventional machine, a large wire receiving drum rests on a rotatable support or turntable 103 which may turn or move slowly to give the wire a well known petal pattern which helps prevent wire snags or hang-ups during a subsequent dispensing operation. In the present invention, a permanent wire receiving basket having a relatively flat surface 77, a plurality of upstanding inner wire guide elements 79, 81 defining the inner periphery of the coil, and an upstanding generally cylindrical outer wire guide 83 defining the outer periphery of the coil as well as the structure supporting this wire receiving basket have been rolled into place replacing the conventional drum. That is, the first station 75 replaces the prior art drum.

The wire basket actually comprises two relatively movable portions, the first including the upstanding inner wire guide elements 79, 81 and outer wire guide 83 which move together under the control of the air or hydraulic cylinders 105 and 107, and the other including the relatively flat surface 77. The relatively flat surface is disposed generally horizontally and located within the cylindrical outer wire guide 83. The wire guide elements 79, 81, along with the outer wire guide cylindrical axis, extend generally vertically upwardly and may be raised while the basket is receiving wire and then lowered to facilitate the wire pack being slid laterally from the first station 75 to the second station 85. Flat surface 77 is supported by tube 78 which in turn rests on rotatable support 103, thus the first movable portion including the flat surface is rotatable about the axis of the cylindrical outer wire guide and rotates with the support 103 during wire dispensing providing the petal pattern to the wire. The other movable portion includes the support plate 109 which lies beneath slat surface 77 and supports the several pins such as 79 and 81 as well as the cylindrical outer wire guide 83. Support plate 109 rests on the piston rods of the two cylinders 105 and 107 and is movable along tube 78 and the axis of the cylindrical outer wire guide 83 to extend the wire guide 83 and wire guide elements 79, 81 above the flat surface 77 for receiving wire and to retract the wire guide and wire guide elements below the flat surface to facilitate removal of the wire and sheet as a packaged unit.

The process of packaging coiled wire according to the present invention should now be abundantly clear. The process includes the steps of laying wire in an annular (typically petal) pattern with a central opening onto a sheet of fiberboard such as corrugated cardboard which sheet has a similar central opening corresponding generally to the central opening in the annular pattern. Thereafter, the free ends of a plurality of strips of adhesive tape are passed upwardly through the two central openings and then radially outwardly, down and radially inwardly to close on themselves and encircle the sheet of fiberboard and the wire. The process may include the additional step of wetting the underneath surface of the fiberboard and tape to subsequently dissolve the tape adhesive and aid adherence of the strips of tape about the sheet of fiberboard and the wire.

From the foregoing, it is now apparent that a novel wire receiving, shipping and dispensing arrangement as well as novel equipment for utilizing such an arrangement have been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. An open-faced container for receiving, transporting, storing and dispensing coil material comprising a relatively flat sheet of support material formed from corrugated cardboard having a peripheral extent approximately coextensive with the outer edges of a coil of coil material to be received thereon, the sheet of support material having a central opening with an inner peripheral extent approximately coextensive with the inner edges of the coil of coil material to be received thereon, both the inner and outer peripheral extents being formed as concentric regular n-gons having respective edges oriented generally parallel to one another, and a plurality of bands comprising a number of lengths of paper tape material each passing through the central opening, about the coil material, and about the outer periphery of the coil material and of the support material to close upon itself for fastening a coil of coil material to a face of the sheet.

2. The open-faced container of claim 1 further comprising n strips of fiberboard material, each extending generally orthogonal to a corresponding one of the pairs of parallel edges, the strips being initially flat and generally coplanar with the support material and subsequently foldable about the sheet of support material and about the coil of coil material and fastenable in place thereabout to secure the coil material to the sheet of support material.

3. The open-faced container of claim 1 further comprising n strips of tape, each strip of tape extending generally orthogonal to a corresponding one of the pairs of parallel edges, the strips being wrappable about the sheet of support material and about the coil of coil material and fastenable in place thereabout to secure the coil material to the sheet of support material.

4. The open-faced container of claim 3 wherein $n=8$.

5. A two part wire receptacle for receiving wire being laid therein in a coiled pattern comprising:

a permanent wire receiving basket having a relatively flat surface supporting a plurality of upstanding inner wire guide elements defining the inner periphery of the coil and a further plurality of upstanding outer wire guide elements defining the outer periphery of the coil; and a relatively flat sheet of support material having a peripheral extent approximately coextensive with the outer wire guide elements, a central opening with a peripheral extent approximately coextensive with the inner wire guide elements, and a plurality of bands for fastening a coil of wire to a face of the sheet so that the wire and sheet may be removed as a packaged unit, and a new sheet placed in the basket to receive additional wire.

6. The two part wire receptacle of claim 5 wherein the bands comprise a number of lengths of tape material each passing through the central opening, about the coil of wire, and about the outer periphery of the coil of wire and of the support material to close upon itself.

7. The two part wire receptacle of claim 6 wherein the sheet of support material is formed from corrugated cardboard.

8. The two part wire receptacle of claim 7 wherein both the inner and outer peripheral extents are formed as concentric regular n-gons having respective edges oriented generally parallel to one another.

9. The two part wire receptacle of claim 8 further comprising n strips of fiberboard material, each extending generally orthogonal to a corresponding one of the pairs of parallel edges, the strips being foldable about the sheet of support material and about the coil of wire and fastenable in place thereabout to secure the coil of wire to the sheet of support material.

10. The two part wire receptacle of claim 8 further comprising n strips of tape, each strip of tape extending generally orthogonal to a corresponding one of the pairs of parallel edges, the strips being wrappable about the sheet of support material and about the coil of wire and fastenable in place thereabout to secure the coil of wire to the sheet of support material.

11. The two part wire receptacle of claim 10 where $n=8$.

* * * * *